United States Patent [19]

Roberts et al.

[11] 4,111,182

[45] Sep. 5, 1978

[54] FRANKLIN STOVE ATTACHMENTS

[76] Inventors: Herbert E. Roberts, R.F.D. #3; Donald D. Wharff, R.F.D. #2, both of Dover-Foxcroft, Me. 04426

[21] Appl. No.: 600,222

[22] Filed: Jul. 30, 1975

[51] Int. Cl.[2] ..... F24H 3/08

[52] U.S. Cl. ..... 126/110 B; 126/66; 126/72

[58] Field of Search ..... 126/110 R, 110 B, 121, 126/66, 99 R, 67, 72, 71

[56] References Cited

U.S. PATENT DOCUMENTS

| | | | |
|---|---|---|---|
| 2,077,599 | 4/1937 | Wales | 126/121 X |
| 2,114,584 | 4/1938 | Aunger | 126/99 R |
| 2,269,387 | 1/1942 | Weaver | 126/110 B |
| 2,283,407 | 5/1942 | Bassett et al. | 126/110 B |
| 2,739,749 | 3/1956 | Braham | 126/110 R |
| 2,742,892 | 4/1956 | Herzer | 126/110 B X |
| 2,884,048 | 4/1959 | Marble et al. | 126/110 R |
| 3,044,460 | 7/1962 | Hoskinson | 126/110 B |
| 3,171,399 | 3/1965 | Kirgan | 126/110 B |
| 3,444,854 | 5/1969 | Fraim | 126/110 R |
| 3,749,078 | 7/1973 | Dupler | 126/121 |

FOREIGN PATENT DOCUMENTS

| | | | |
|---|---|---|---|
| 66,022 | 3/1943 | Norway | 126/72 |

*Primary Examiner*—William E. Wayner
*Assistant Examiner*—William E. Topolcai, Jr.
*Attorney, Agent, or Firm*—Shlesinger, Fitzsimmons & Shlesinger

[57] ABSTRACT

The stove combustion chamber is lined with a layer of refractory material. Above this a baffle extends at an angle upwardly from the rear wall of the stove part way toward its front wall. Three tubular heat exchangers open at their forward ends on a grill on the front of the stove, and extend rearwardly over the combustion chamber and baffle to a duct mounted on the rear of the stove. The refractory material and baffle help retain heat in the stove to keep the heat exchange tubes warm, and a blower, which is connected to the duct and is controlled by a thermostat, blows warm air from inside the tubes outwardly through the grill into the room containing the stove.

3 Claims, 4 Drawing Figures

FRANKLIN STOVE ATTACHMENTS

This invention relates to Franklin-type stoves, and more particularly to attachments for improving the heating efficiency of this type of stove.

Particularly because of recent fuel shortages, the popularity of the well-known Franklin-type stove has increased noticeably. The basic Franklin stove can be made small enough to fit readily into the average size family room or kitchen, and is particularly suited for use with such fuels as firewood, although other fuels such as coal, or the like, may be employed if desired.

Stoves of the type described are usually made of cast iron, and normally are intended to heat both by radiation and convection. One of the difficulties with this type of stove, however, is that most of the heat which it generates is radiated from its cast iron walls and remains in the immediate vicinity of the stove, thus making it extremely difficult to maintain a reasonably average temperature throughout the room in which the stove is located. Another disadvantage is that much of the heat from the combustion chamber is exhausted directly out of the flue to which the stove is attached.

It is an object of this invention, therefore, to provide for a stove of the type described a series of attachments which enable the stove to transmit heat much more uniformly to a room, thus more efficiently.

Another object of this invention, is to provide novel means for reducing the quantity of heat radiated from a stove of the type described, and increasing the quantity of heat transmitted by convexion currents from such a stove.

Still another object of this invention is to provide for a stove of the type described a heat exchanger which enables more of the heat generated in the stove to be transmitted by forced convextion, rather than by radiation.

Another object of this invention also is to reduce the amount of heat wasted by stoves of the type described, both as a result of uncontrolled radiation and flue exhaust.

Other objects of this invention will be apparent hereinafter from the specification and from the recital of the appended claims, particularly when read in conjunction with the accompanying drawings.

Figure 2:
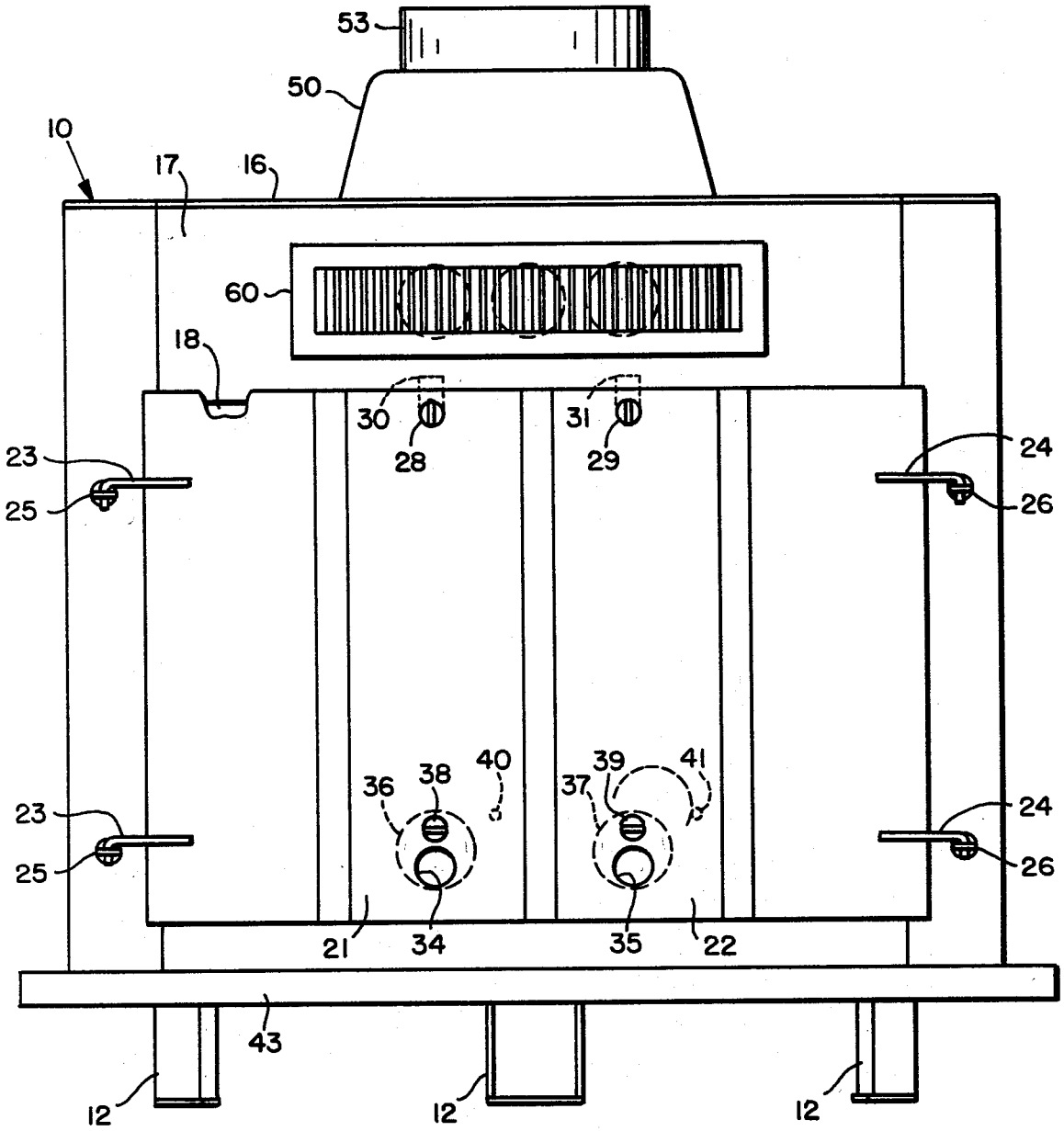
FIG. 2 is a front elevational view of this stove with part of one of its front doors broken away.

Referring now to the drawings by numerals of reference, 10 denotes generally the frame of a Franklin-type stove comprising a plane bottom wall 11 (FIGS. 3 and 4), which is supported on three, spaced, channel iron sections or feet 12, a vertically disposed rear wall 13, two side walls 14 and 15, which diverge forwardly from the rear wall 13, a horizontally disposed top wall 16, and a plane front wall 17. Adjacent its lower end the front wall 17 has therein a large rectangular opening 18 (FIG. 2) covered by a pair of folding doors 21 and 22, each of which is hung for swinging movement into and out of its closed position (FIG. 2) over the opening 18 by a pair of vertically spaced rod hinges 23 and 24, respectively. These hinges 23 and 24 are fastened at one end on the outsides of the doors 21 and 22, respectively, and have downwardly bent portions at their opposite ends that are pivotally mounted in registering openings in a pair of vertically spaced plates or brackets 25 and 26, respectively, which project from the face of the front wall 17 adjacent opposite sides thereof. Knobs 28 and 29, which project from the doors 21 and 22, respectively, are rotatably mounted in their respective doors, and have on their inner ends lateral tongues or projections 30 and 31, respectively, which can be swung by the associated knob upwardly behind the front wall 17 adjacent the upper edge of opening 18 selectively to secure the doors 21 and 22 in their closed positions.

For controlling the draft in the stove's combustion chamber, circular openings 34 and 35 are located in the doors 21 and 22 adjacent the lower ends thereof, and may be closed by a pair of circular plates or discs 36 and 37, respectively, which are mounted on the inner ends of knobs 38 and 39 for pivotal movement on the insides of the doors. Each disc 36 and 37 can be swung by its associated knob 38 or 39 clockwise (FIG. 2) into an open position illustrated, for example, by the upper, broken line position of the disc 37 in FIG. 2, wherein the disc engages a pin or stop 41, which projects from the inside face of the door 22 to support the disc 37 in its open position. A similar stop 40 is provided on the inside of door 21 for the disc 36.

Integral with, and projecting forwardly from the front wall of the frame 10 beneath the lower edges of the doors 21 and 22 ia a rigid platform 43, which can be used as a footstand or to support objects in front of the stove.

Figure 1:
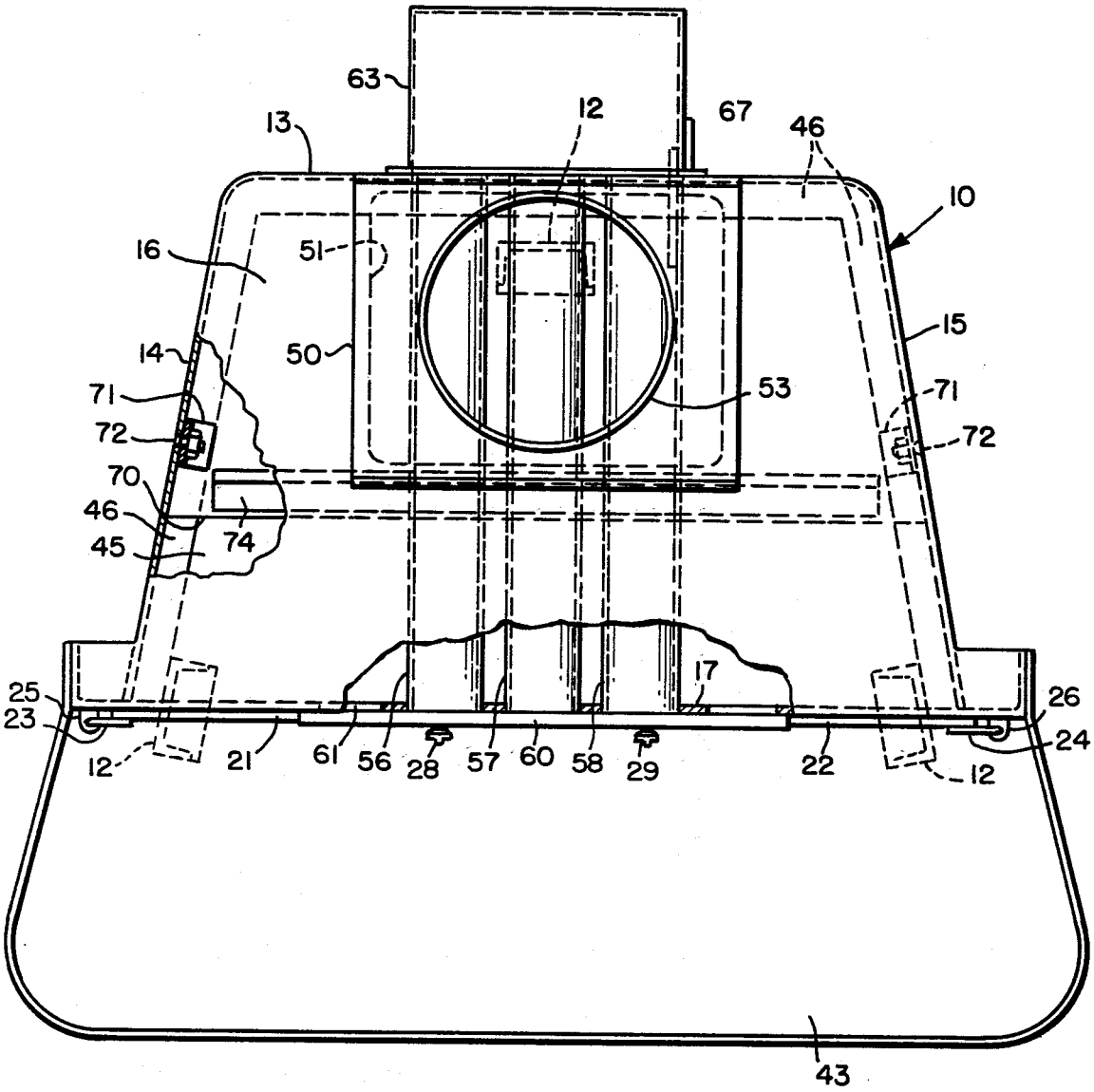
FIG. 1 is a plan view of a Franklin stove having attachments of the type made according to one embodiment of this invention, a portion of the stove wall being broken away and shown in section for purposes of illustration.

Mounted inside the stove on the bottom 11 of the frame is a thick layer 45 (FIGS. 1 and 3) of refractory material. A layer 46 of similar refractory material is mounted in the stove to cover the inside surfaces of the rear wall 13 and the two side walls 14 and 15 from the bottom layer 45 to a point of approximately midway between the upper and lower walls 16 and 11 of the frame.

Mounted on the upper wall 16 adjacent its rear edge, and located medially of the sides 14 and 15 of the frame, is a large plenum 50, which communicates through a rectangular opening 51 (FIGS. 1 and 3) in the wall 16 with the combustion chamber or interior of the frame 10. A flue pipe 53, which is fastened to the upper end of plenum 50, also communicates with the interior frame 10 through an opening 54 (FIG. 3) in the top of the plenum, and through the opening 51 in the wall 16.

Secured at opposite ends in the rear wall 13 and front wall 17, repsectively, of the frame 10 are three, spaced, parallel, horizontally disposed tubular heat exchangers 56, 57 and 58. The forward ends of these tubular members open on a deflector type grill 60 (FIGS. 1 to 3), which is secured over an opening 61 (FIG. 1) in the front wall 17 of the frame. The rear ends of members 56, 57 and 58 communicate through registering openings in the rear wall 13 with the upper end of a duct 63, which is fastened on the back of frame 10. Secured to the lower end of duct 63 is a blower 64 (FIGS. 3 and 4), which is driven by an electrical motor 65 that is attached to one side of the blower housing. When the electric motor 65 is energized, cool air from adjacent the bottom of the stove is drawn into the blower 64 through an opening (not illustrated) in the blower housing, and is discharged by the blower into the lower end of duct 63. This duct conveys the air upwardly and through the interior of the tubular heat exchangers 56, 57 and 58, where the air is heated before being discharged out of the grill 60 at the front side of the stove.

Figure 4:
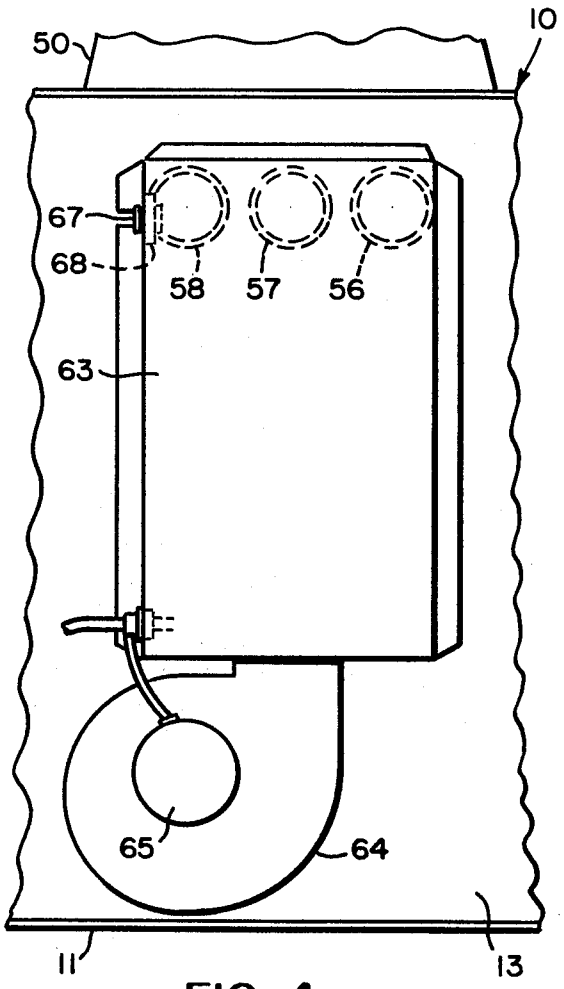
FIG. 4 is a fragmentary rear elevational view of this stove.
Figure 3:
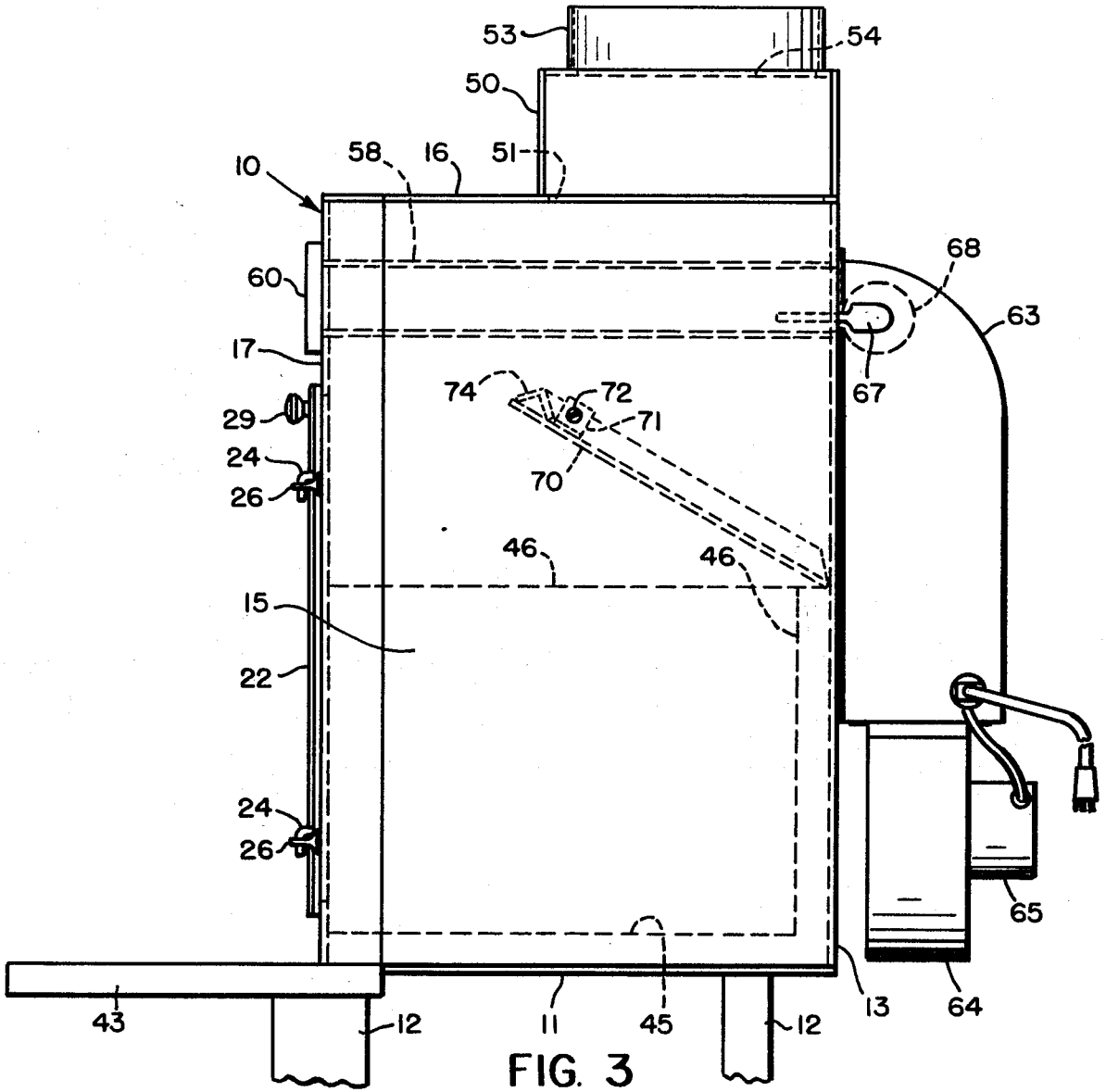
FIG. 3 is a fragmentary side elevational view of this stove.

Mounted in the rear wall 13 of the frame adjacent the upper end of duct 63, and extending at its inner end into the interior of frame 10 is a conventional heat sensory unit 67 (FIGS. 3 and 4). This unit controls a thermostat 68, which is connected in known manner to the electrical motor 65 to control operation thereof.

Mounted in the frame 10 with its rear edge extending along the juncture of the rear wall 13 and the upper edge of the layer 46 of the refractory material, and extending diagonally upwardly toward the undersides of the heat exchangers 56, 57 and 58, and partway toward the front wall 17 of the frame, is a large, rectangular plate or baffle 70. This plate, which extends transversely across the entire width of the frame 10, has its forward edge spaced beneath the heat exchangers 56, 57 and 58, and slightly forwardly of the large rectangular opening 51 in the upper wall 16, so that it functions as a baffle which slows down the upward flow of hot gases that are generated by combustion when the stove is in use. Adjacent its forward edge plate 70 is secured by a pair of right-angular brackets 71 and screws 72 (FIG. 1) to opposite sides 14 and 15 of the frame. An elongate angle iron 74 is secured to plate 71 adjacent its forward edge to reinforce the plate and to resist warping thereof during use. Additional reinforcing members may, of course, be secured along the side edges of plate 70, as desired.

In use, after a fire has been started in the frame 10 above the bottom layer 45 of refractory material, and generally within the area bounded by the layer 46, the rate at which the heat flows upwardly from the fire toward the flue pipe 53 is slowed considerably by the baffle 70, and affords more complete combustion within the chamber beneath the baffle. When the sensory unit 67 senses that the temperature adjacent the heat exchangers has reached a predetermined value, for example a temperature of 120° F., it activates the thermostat 68, which in turn starts the blower motor 65 in known manner. The blower 64 then draws cold air from adjacent the floor upon which the stove is mounted, and blows this air through the duct 63 into the heat exchanger tubes 56, 57 and 58, where the cold air is warmed before being forced by the blower 64 out of the forward ends of the exchangers and through the grill 60 on the front of the unit. If desired, the sensor 67 may be set to deenergize the blower 65 whenever the temperature in the upper end of the stove reaches a predetermined value, for example whenever the temperature drops below 100° F. The exact circuitry which is employed to effect these controls forms no part of this invention, and is therefore not described in detail herein.

From the foregoing it will be apparent that the instant invention provides relatively simple and inexpensive means for considerably increasing the efficiency of the Franklin-type stove. The layers 45 and 46 of refractory material retain a considerable amount of heat which would otherwise be radiated away from the unit and wasted. The heat retained by these layers allows the heat exchanger tubes 56, 57 and 58 to pick up a greater amount of heat, and to transfer this heat to the cool air which is blown through the tubes by the blower 64. Consequently the generated heat is distributed more efficiently and faster, as compared for example to the plain Franklin stove, from which heat is dispensed solely by radiation and simple convection (i.e., convection currents generated solely by the heat rising from the stove). Furthermore, the heat discharged from this improved stove can be delivered over a greater range than if the stove were to heat by simple convection and radiation; and through the use of the sensory unit 67, this distribution of heat can be controlled more accurately, so that the room in which the stove is located can be maintained at a more uniform temperature.

While the invention has been described in connection with the use of three heat exchanger tubes, it will be understood that the exact number of tubes employed is but a matter of choice, and may be varied, depending upon the overall size of the stove. Moreover, it will be apparent also that the refractory material (layers 45 and 46), the baffle 70, the blower 64, the duct 63 and the associated electrical parts are readily removable for repair or replacement, if necessary. This form of construction also permits these elements to be added with little effort to a conventional stove at any time.

While only a single embodiment of this invention has been illustrated and described in detail herein, it will be apparent that the invention is capable of further modification, and that this application is intended to cover any such modifications that may fall within the scope of one skilled in the art or the appended claims.

Having thus described our invention, what we claim is:

1. A stove, comprising a frame having therein a combustion chamber, at least one door movably mounted on the front wall of said frame over an access opening which communicates with said chamber selectively for inserting fuel into, and for withdrawing ashes from said chamber, a plenum mounted on top of said frame for connection to a flue, and communicating with said chamber through an exhaust opening formed in the top of said frame adjacent the rear wall thereof, a plurality of spaced, tubular heat exchangers extending through said combustion chamber adjacent the upper end thereof, and opening at their forward ends on a further opening formed in said front wall of said frame above said access opening, and opening at their rear ends in registering openings formed in the rear wall of said frame, a baffle mounted in said chamber beneath said heat exchangers and registering vertically with said exhaust opening in said top of the frame to slow the discharge of heat from said chamber to said plenum, a vertical duct mounted on the outside of said frame and having its upper end connected to the rear ends of said exchangers, an electrically-operated blower connected to the lower end of said duct with its air inlet positioned adjacent the bottom of said frame, and operable to draw cool air from adjacent the floor upon which said frame is mounted, and to blow this cool air upwardly through said duct and axially through said exchangers to be heated thereby, when the stove is in use, a first layer of refractory material covering the bottom of said frame in said chamber, and a further layer of refractory material covering the inside of said chamber between said first layer and baffle, said further layer having an opening therein registering with said access opening in said front wall of the frame, said baffle comprising a plate removably mounted in said chamber and having its rear edge positioned adjacent the rear wall of said frame above said further layer of refractory metal, and extending diagonally forwardly and upwardly part way toward said front wall and the undersides of said heat exchangers, and the opening formed between said front wall and the forward edge of said plate being offset horizontally from said exhaust opening in the top of said frame.

2. A stove as defined in claim 1, wherein said tubular heat exchangers extend in spaced, parallel relation rearwardly from said front wall above said baffle and beneath and adjacent to said opening in the top of said frame whereby hot air rising from said chamber is directed by said baffle forwardly and upwardly toward the forward ends of said exchangers, and then passes longitudinally rearwardly of said exchangers to said opening in the top of said frame.

3. A stove as defined in claim 2, including heat sensing means mounted on said rear wall of said frame and extending into said chamber above said baffle and rearwardly of said forward edge thereof to detect the ambient temperature adjacent said exchangers, and thermostatic control means connecting said sensing means to said blower to effect operation of the latter when said ambient temperature exceeds a predetermined value.

* * * * *